US012310540B1

(12) United States Patent
Chen

(10) Patent No.: US 12,310,540 B1
(45) Date of Patent: May 27, 2025

(54) FOLDABLE BABY BATHTUB

(71) Applicant: Xiao Chen, Taizhou (CN)

(72) Inventor: Xiao Chen, Taizhou (CN)

( * ) Notice: Subject to any disclaimer, the term of this patent is extended or adjusted under 35 U.S.C. 154(b) by 0 days.

(21) Appl. No.: 18/829,778

(22) Filed: Sep. 10, 2024

Related U.S. Application Data

(63) Continuation-in-part of application No. 18/607,406, filed on Mar. 15, 2024.

(51) Int. Cl.
*A47K 3/064* (2006.01)

(52) U.S. Cl.
CPC ..... *A47K 3/064* (2013.01)

(58) Field of Classification Search
CPC ..... A47K 3/064
USPC ..... 4/572.1
See application file for complete search history.

(56) References Cited

U.S. PATENT DOCUMENTS

| | | | | |
|---|---|---|---|---|
| 6,507,959 | B1 * | 1/2003 | Sundberg | A47K 3/127 4/584 |
| 2013/0198947 | A1 * | 8/2013 | Yeung | A47K 3/00 4/585 |
| 2020/0323396 | A1 * | 10/2020 | Mutch | A47K 3/064 |
| 2022/0274739 | A1 * | 9/2022 | Mu | A47D 9/005 |

* cited by examiner

*Primary Examiner* — Huyen D Le

(57) ABSTRACT

A foldable baby bathtub includes a bathtub and a handle connected to the bathtub. The bathtub includes a bottom plate and a sidewall connecting the bottom plate, the bottom plate extends upward around to form the sidewall, the bottom plate and the sidewall are configured to form a cavity for holding a baby body, an edge of the sidewall extends outwardly to form an outer edge, and the bathtub includes a stretched state and a contracted state in a longitudinal axis direction of the bathtub.

20 Claims, 18 Drawing Sheets

FOLDABLE BABY BATHTUB

CROSS-REFERENCE TO RELATED APPLICATIONS

This application is a Continuation-in-Part of the U.S. application Ser. No. 18/607,406 filed on Mar. 15, 2024, and entitled "FOLDABLE BABY BATHTUB," now pending, the entire disclosures of which are incorporated herein by reference.

TECHNICAL FIELD

The present invention relates to the field of baby products, in particular to a foldable baby bathtub.

BACKGROUND

At present, foldable baby bathtubs are widely available in the market. The size of these bathtubs can be adjusted to fit babies and provide additional support for them. When bathing a baby, parents need to hold the baby with one arm and bathe the baby with the other arm to protect the baby. However, the additional support provided by conventional baby bathtubs is usually only available in the reclining or supine position and does not provide support beyond a simple backrest when infants are in the sitting or upright position. In many cases, infants may move restlessly due to discomfort, leading to a risk of slips and injuries. Moreover, due to the large storage volume of the baby bathtub's bath cavity, it is difficult to store.

The U.S. patent with application Ser. No. 11/395,564 discloses a bathtub with an expandable structure. The bathtub can be adjusted to its size to adapt to the growth of babies. However, the large volume area of the bathtub makes it more difficult to store. In addition, the U.S. patent with U.S. Pat. No. 7,032,259 discloses a foldable baby bathtub. The bathtub can be adjusted to its height to adapt to caregivers bathing infants more comfortably. However, a leg supporting member of the bathtub is not detached, making it more difficult to store.

SUMMARY

The present disclosure provides a foldable baby bathtub. The foldable baby bathtub includes:

a bathtub; and a handle connected to the bathtub, wherein the bathtub includes a bottom plate and a sidewall connecting the bottom plate, the bottom plate extends upward around to form the sidewall, the bottom plate and the sidewall are configured to form a cavity for holding a baby body, an edge of the sidewall extends outwardly to form an outer edge, and the bathtub includes a stretched state and a contracted state in a longitudinal axis direction of the bathtub.

As an improvement of the present disclosure, the baby bathtub further includes a leg member detachably connected to the bathtub, at least one connecting member is respectively arranged at each of two ends of the outer edge, the leg member is detachably connected to the bathtub by the connecting member, the connecting member is provided with a locking device, and the locking device limits and releases the leg member thereby leaving the leg member in a locked state or a relaxed state.

As an improvement of the present disclosure, the outer edge forms an annular groove with an outer surface of the sidewall, at least one extended part is arranged at each of two ends of the annular groove, at least one first receiving part is arranged at an upper end of the connecting member, and the first receiving part is received the extended part so that the connecting member is fixedly connected to the outer edge.

As an improvement of the present disclosure, one side of the connecting member is provided with a groove, the other side of the connecting member is provided with a mounting hole, and the locking device is fixedly arranged in the mounting hole.

As an improvement of the present disclosure, the locking device includes a locking part and a rotating part, the rotating part is able to rotate along a central axis, so as to drive the locking part to rotate for limiting and releasing the leg member.

As an improvement of the present disclosure, the leg member includes a connecting end, one side of the connecting end is provided with a convex strip, the convex strip is matingly connected to the groove, the other side of the connecting end is provided with a locking groove, and the locking groove is received the locking part.

As an improvement of the present disclosure, the leg member is provided with a U-shaped structure, and at least one anti-slip bump is arranged at a bottom of the leg member.

As an improvement of the present disclosure, the outer edge is provided with a tray, and the tray is configured to support bath accessories.

As an improvement of the present disclosure, the bottom plate is provided with a drain opening, and at least one supporting block is provided on a lower surface of the bottom plate.

As an improvement of the present disclosure, the drain opening is provided with an on-off valve, and the on-off valve is configured to control a discharge of water.

As an improvement of the present disclosure, the bathtub is made of rubber material.

As an improvement of the present disclosure, the baby bath further includes at least one supporting member, the supporting member is in a U-shaped structure, and at least one anti-slip bump is arranged at a bottom plate of the supporting member.

As an improvement of the present disclosure, a fixing member is arranged at each of two ends of the outer edge, the supporting member is fixedly connected to the outer edge by the fixing member, the fixing member includes at least one second receiving part, and the second receiving part is received and fixed the extended part, so that the fixing member is fixedly connected to the outer edge.

As an improvement of the present disclosure, a receiving groove is arranged on each of two sides of an interior of the fixing member, and a connecting shaft is arranged on each of two sides of an upper end of the supporting member, and the receiving groove is configured to receive and fix the connecting shaft, so that the supporting member is connected to the fixing member.

As an improvement of the present disclosure, at least one connecting part is further arranged on the outer edge, the handle is provided with a gripping end and at least one connecting end disposed on at least one end of the gripping end, and the connecting end is detachably connected to the bathtub by the at least one connecting part.

As an improvement of the present disclosure, the connecting part is further provided with a snap groove and a connecting column, the handle is provided with a connecting hole and a snap fastener, the connecting column is inserted into the connecting hole, and the snap groove is configured to receive and fix the snap fastener, so that the handle is able to detachably mount on the bathtub.

As an improvement of the present disclosure, the gripping end includes a contact wall, the contact wall is provided with a plurality of abutting blocks on an inner wall surface of the contact wall, and the abutting block abuts against the outer edge, so that a gap is formed between the contact wall and the outer edge.

As an improvement of the present disclosure, the handle is a flexible handle.

As an improvement of the present disclosure, the annular groove is further provided with a mounting part, the mounting part is disposed on one of two sides of the annular groove, the mounting part is provided with a clamping strip, the mounting part is further provided with a baffle board on one side of the mounting part, and the baffle board is provided with a through hole.

As an improvement of the present disclosure, the handle is mounted on the mounting part, an upper portion of the handle is provided with a clamping groove, the clamping groove is matingly connected to the clamping strip, and each of two ends of the handle is provided with a protruding part, and the protruding part is passed through and disposed into the through hole.

BRIEF DESCRIPTION OF THE DRAWINGS

In order to explain the technical solutions of the embodiments of the present disclosure more clearly, the following will briefly introduce the accompanying drawings used in the embodiments. Apparently, the drawings in the following description are only some embodiments of the present disclosure. Those of ordinary skill in the art can obtain other drawings based on these drawings without creative work.

DETAILED DESCRIPTION OF THE EMBODIMENTS

Figure 1:
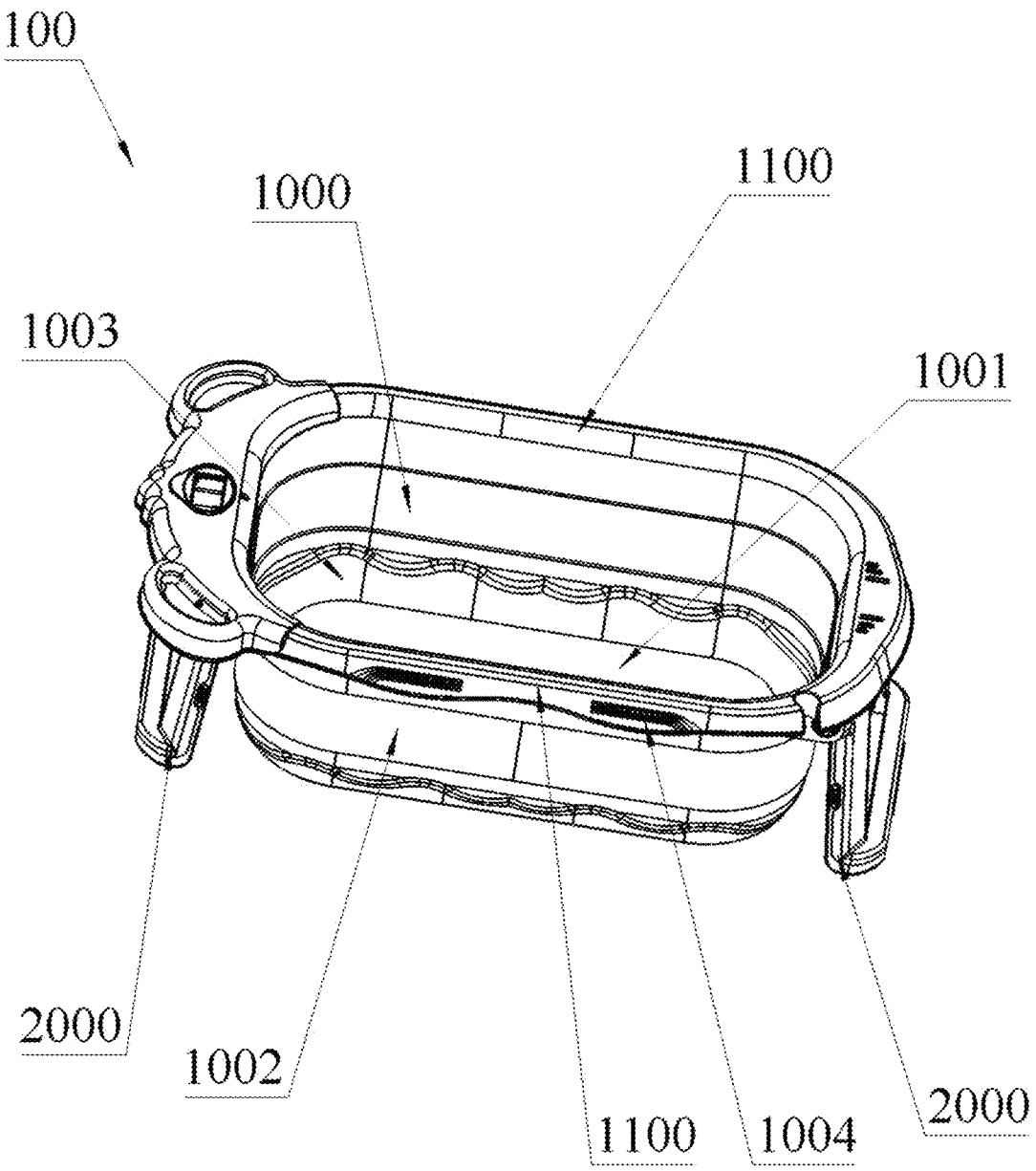
FIG. 1 is a schematic diagram of an overall structure of a foldable baby bathtub of the present invention.

The accompanying drawings in the embodiment of the present disclosure are combined, The technical scheme in the embodiment of the present disclosure is clearly and completely described, Obviously, the described embodiment is only a part of the embodiment of the present disclosure, but not all embodiments are based on the embodiment of the present disclosure, and all other embodiments obtained by ordinary technicians in the field on the premise of not doing creative work belong to the protection range of the present disclosure.

References to "embodiments" or "embodiments" herein imply that specific features, structures or characteristics described in conjunction with the embodiments or embodiments may be included in at least one embodiment of this application. The presence of the phrase at various points in the specification does not necessarily refer to the same embodiment, nor is it a separate or alternative embodiment that is mutually exclusive with other embodiments. It is understood explicitly and implicitly by those skilled in the art that embodiments described herein may be combined with other embodiments.

In the description of the present application, it is to be understood that, terms such as "front, rear, up, down, left or right", "transverse, longitudinal, vertical, or horizontal", "top or bottom", and the like are usually based on the orientation or positional relationships shown in the drawings and are used only to facilitate and simplify the description of the present application. In the absence of any indication to the contrary, these orientation words do not indicate and imply that the device or component referred to must have a particular orientation or be constructed and operated in a particular orientation, and therefore cannot be construed as limiting the scope of protection of the present application. The orientation word "inside or outside" refers to the inside and outside relative to the contours of the components themselves.

Referring to FIG. 1, a foldable baby bathtub 100 of the present invention includes a bathtub 1000, a handle 1100 connected to the bathtub and a leg member 2000 detachably connected to the bathtub 1000. The bathtub 1000 includes a bottom plate 1001, the bottom plate 1001 extends upward around to form a sidewall 1002, the bottom plate 1001 and the sidewall 1002 are configured to form a cavity 1003 for holding a baby body, an edge of the sidewall 1002 extends outwardly to form an outer edge 1004, the bathtub 1000 includes a stretched state and a contracted state in a longitudinal axis direction of the bathtub 1000, and two connecting members 3000 are respectively arranged on a lower portion of each of two ends of the outer edge 1004. Since the bathtub 1000 is detachably connected to the leg members 2000, it can be detached when the foldable baby bathtub is not in use, making it easy to store and carry, saving space. Moreover, the bathtub 1000 can be stretched and contracted in the direction of the longitudinal axis. This not only allows it to be adjusted to fit the size of a baby's body but also makes storage easier.

Figure 2:
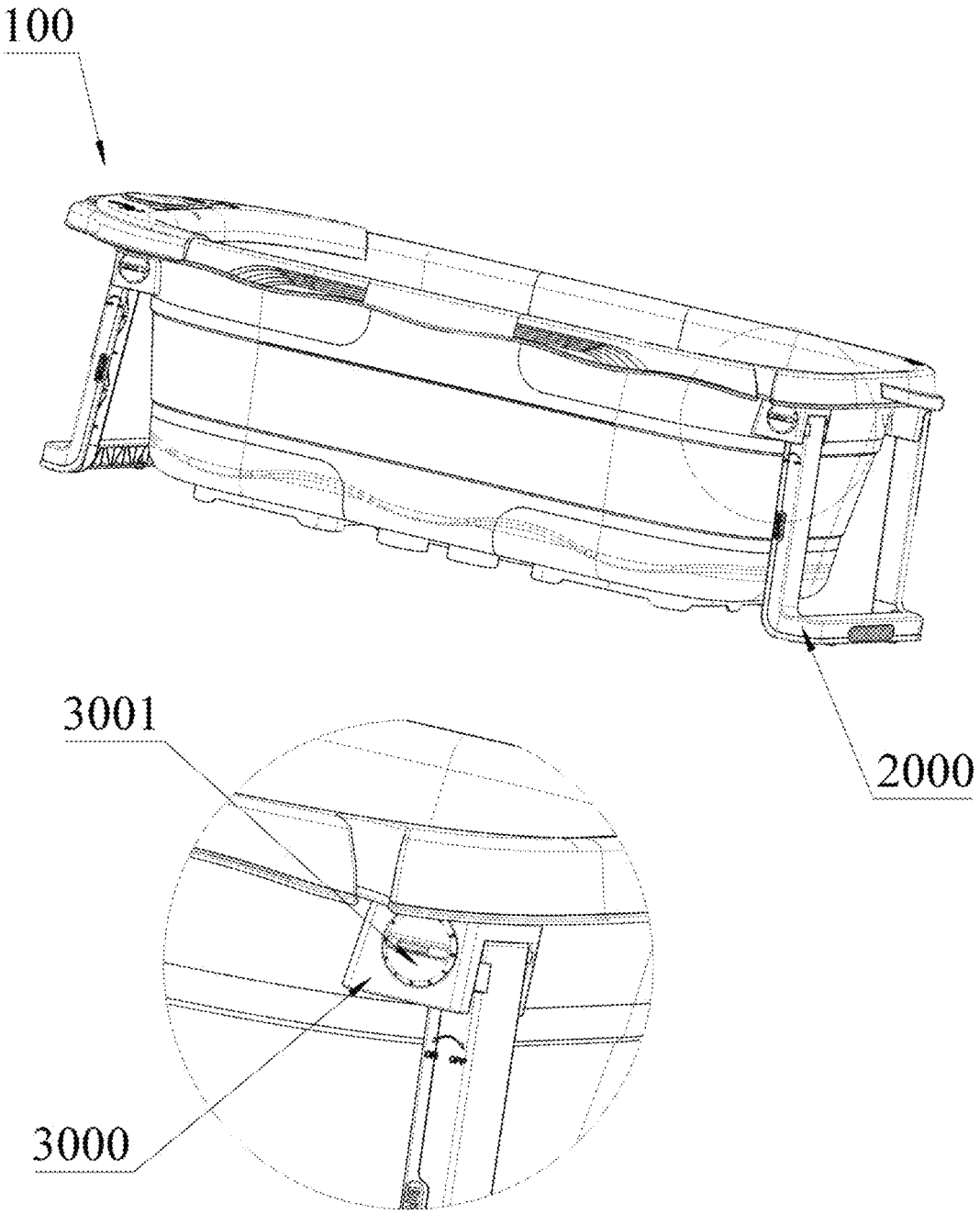
FIG. 2 is a schematic diagram of a connection structure of a leg member connected to a bathtub of the foldable baby bathtub of the present invention.

Referring to FIG. 2, the leg member 2000 is detachably connected to the bathtub 1000 by a connecting member 3000, the connecting member 3000 is provided with a locking device 3001, and the locking device 3001 limits and releases the leg member 2000 thereby leaving the leg member 2000 in a locked state or a relaxed state. The locking device 3001 effectively fixes the leg members 2000 so that they are more stable and less likely to tip over during use, which improves the safety of the product, and the locking device 3001 limits and releases the leg members 2000, which makes it more convenient to mount and detach the foldable baby bathtub 100, thereby improving the user's experience.

In another embodiment (no schematic diagram), a plurality of massage particles are arranged on an inner wall surface of bathtub 1000. The massage particles can gently stimulate a baby's skin during bathing, promoting blood circulation and metabolism while also enhancing the baby's bathing pleasure and interest.

Figure 3:
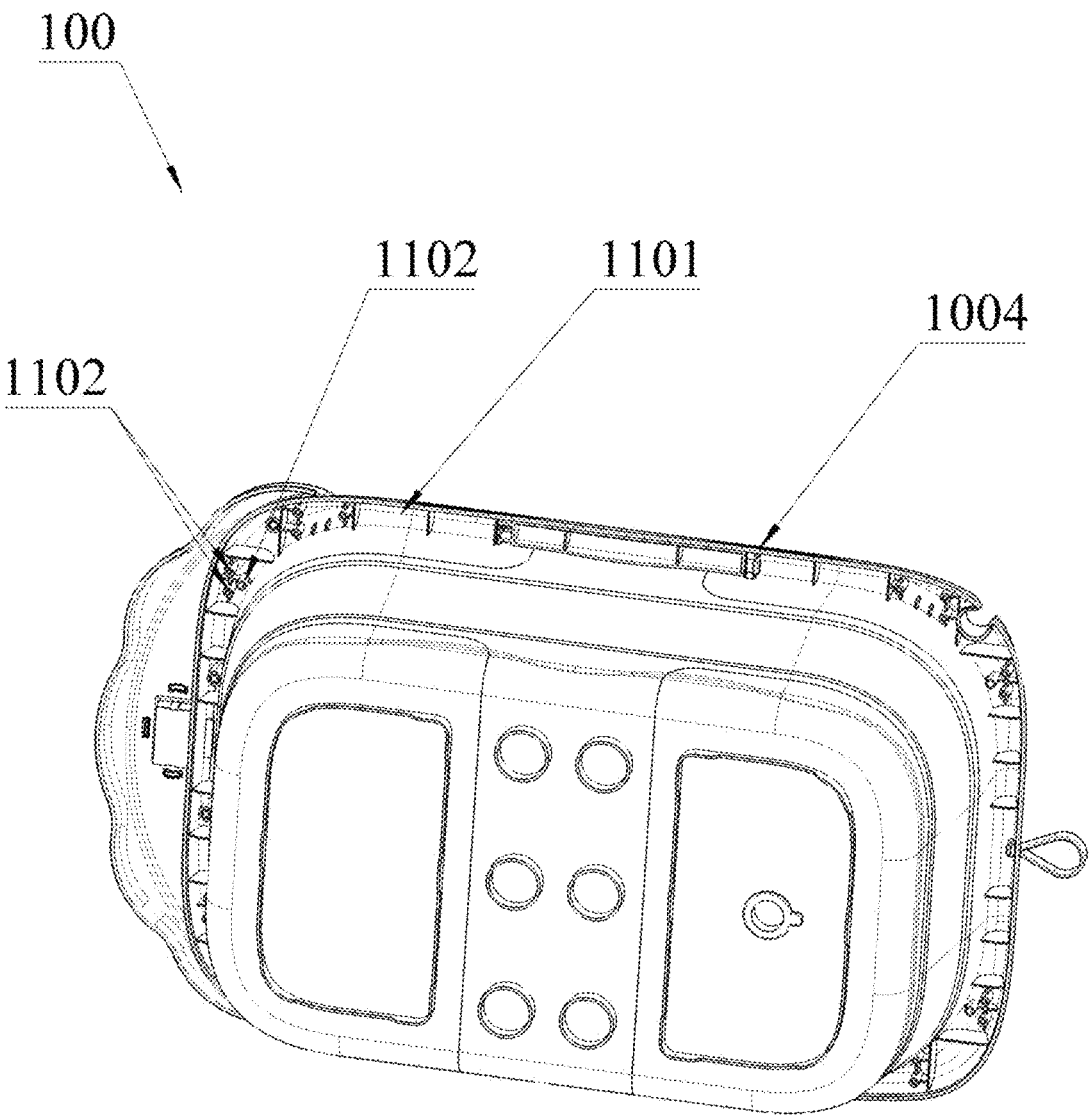
FIG. 3 is a schematic diagram of a connection structure of a connecting member connected to an outer edge of the foldable baby bathtub of the present invention.
Figure 4:
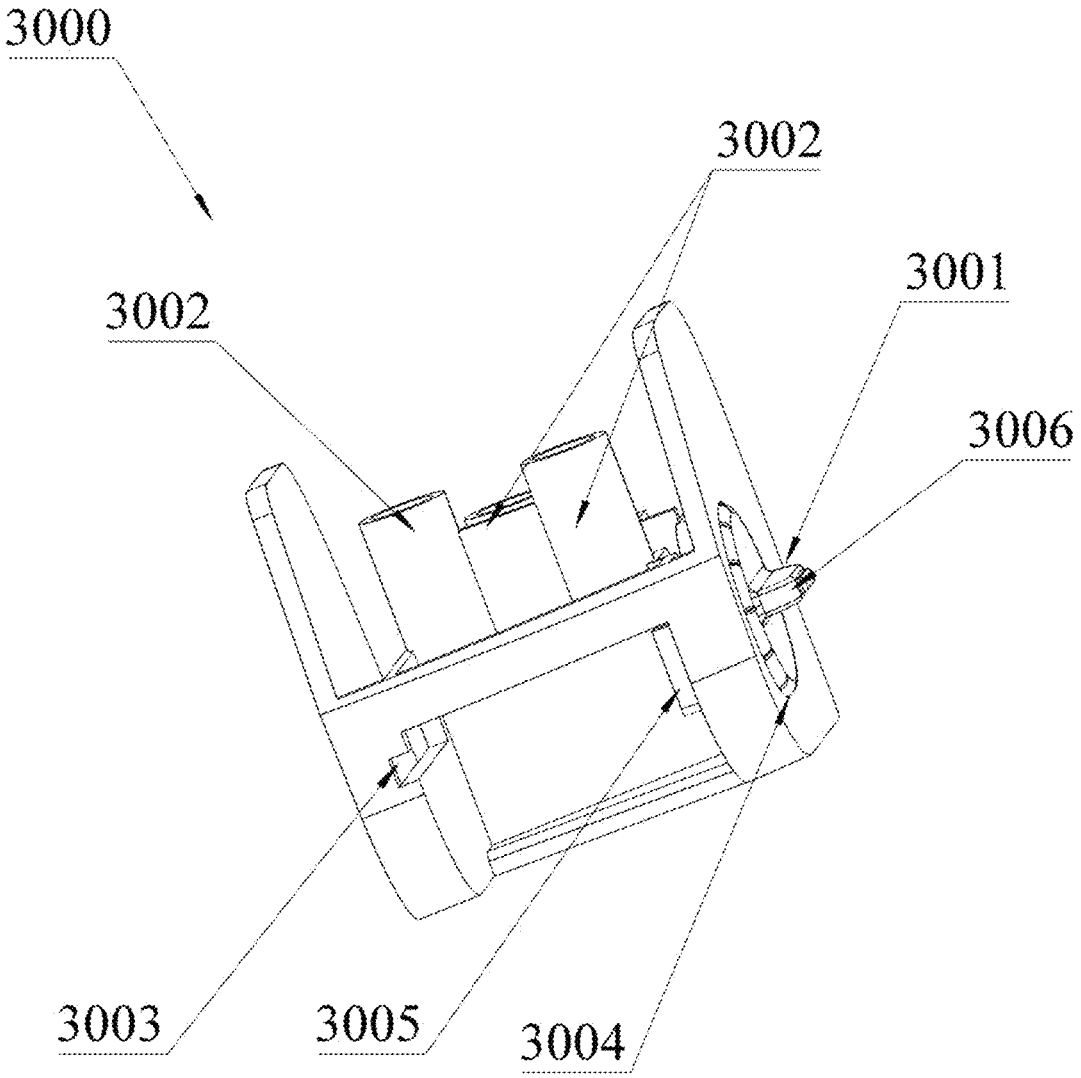
FIG. 4 is a schematic diagram of a structure of the connecting member of the foldable baby bathtub of the present invention.

In this embodiment, referring to FIG. 3 to FIG. 4, the outer edge 1004 forms an annular groove 1101 with an outer surface of the sidewall 1002, three extended parts 1102 are respectively arranged at each of two ends of the annular groove 1101, three first receiving parts 3002 are arranged at an upper end of the connecting member 3000.

The first receiving part 3002 receives the extended part 1102 so that the connecting member 3000 is fixedly connected to the outer edge 1004. Moreover, the first receiving part 3002 is received the extended part 1102 makes it easier to connect the connecting member 3000 to the bathtub 1000 and improves the mounting efficiency of the foldable baby bathtub 100.

In another embodiment, at each of the two ends of the annular groove 1101, four extended parts 1102 or any other configuration in a desired number can be arranged. Likewise, at the upper end of the connecting member 3000, four first receiving parts 3002 or any other configuration in a desired number can be arranged. Thus, the stability of the connection between the connecting member 3000 and the outer edge 1004 can be further enhanced.

In this embodiment, one side of the connecting member 3000 is provided with a groove 3003, the other side of the connecting member 3000 is provided with a mounting hole 3004, and the locking device 3001 is fixedly arranged in the mounting hole 3004. The locking device 3001 includes a locking part 3005 and a rotating part 3006, the rotating part 3006 can rotate along a central axis, so as to drive the locking part 3005 to rotate for limiting and releasing the leg member 2000. Since the rotating part 3006 can rotate along a central axis, this design allows users to control the locking part 3005 by a simple rotating operation, thereby conveniently limiting and releasing the leg member 2000 and improving the ease of operation of the foldable baby bathtub 100.

Figure 5:
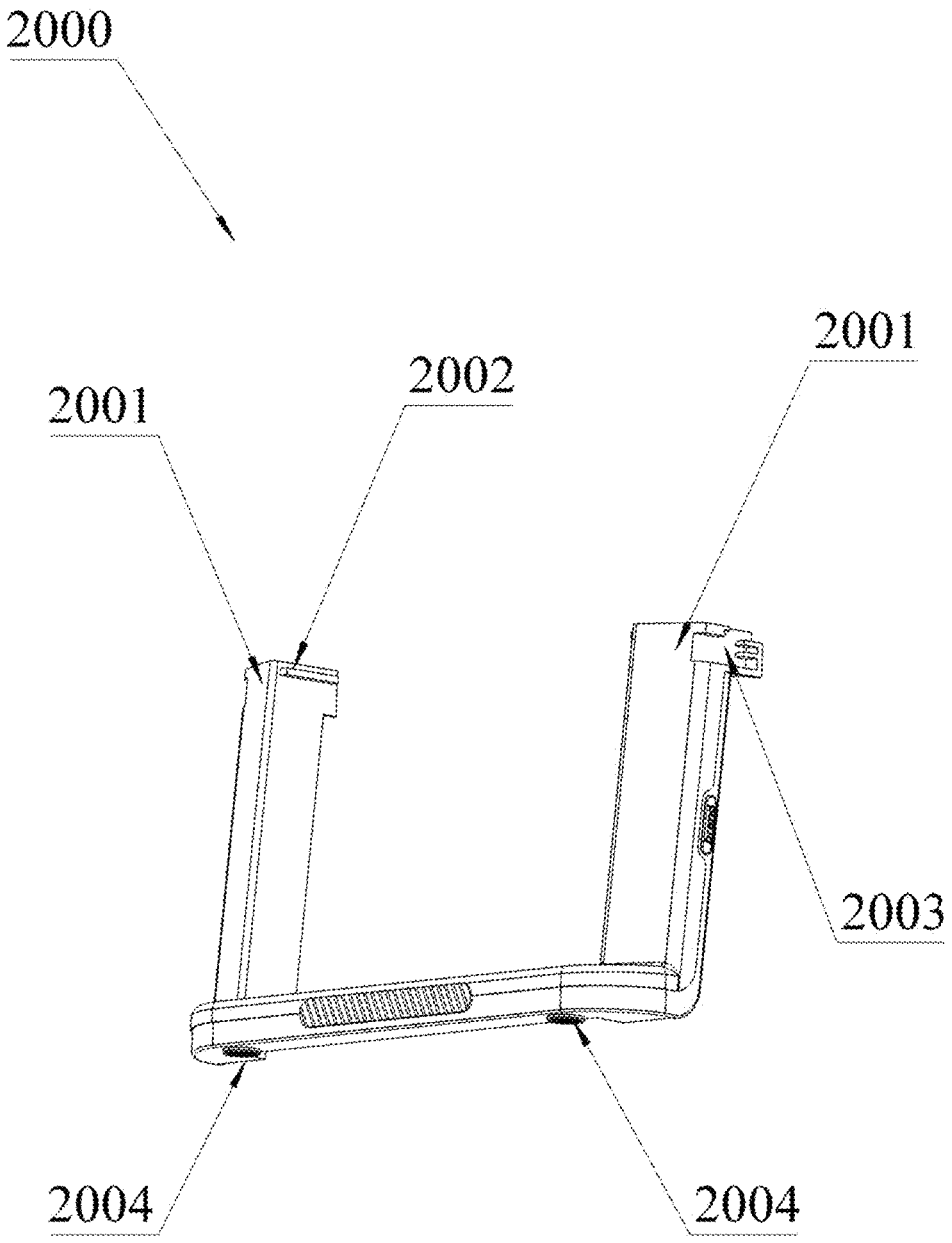
FIG. 5 is a schematic diagram of a structure of the leg member of the foldable baby bathtub of the present invention.

In this embodiment, referring to FIG. 5, the leg member 2000 includes a connecting end 2001, one side of the connecting end 2001 is provided with a convex strip 2002, the convex strip 2002 is matingly connected to the groove 3003, the other side of the connecting end 2001 is provided with a locking groove 2003, and the locking groove 2003 is received the locking part 3005. Since the convex strip 2002 is matingly connected to the groove 3003, a contact area between the connecting member 3000 and the leg member 2000 can be increased, thereby improving the stability of the foldable baby bathtub 100. And since the locking groove 2003 is received the locking part 3005, which allows users to control the leg member 2000 by a simple operation, improving the ease of operation of the foldable baby bathtub 100.

In another embodiment, the connecting end 2001 and the connecting member 3000 are respectively provided with a threaded hole, and the connecting member 3000 and the leg member 2000 are tightly connected by a screw bolt. Through the screw bolt connection, the connection strength and reliability of the leg member 2000 can be effectively improved. It can prevent loosening and falling off between the connecting member 3000 and the leg member 2000, and ensure the stability and safety of the leg member 2000. At the same time, it can also facilitate the detachment and replacement of the leg member 2000. By merely loosening or tightening the screw bolt, the operation becomes simple and swift, saving time and cost while enhancing efficiency and increasing ease of use.

In this embodiment, the leg member 2000 is provided with a U-shaped structure, and two anti-slip bumps 2004 are arranged at a bottom of the leg member 2000. The leg member 2000 is structured in a "U" shape, which not only enhances the stability and load-bearing capacity of the leg member 2000 but also prevents it from tilting or breaking during use, thereby improving its service life and safety. By providing the anti-slip bump 2004, the friction between the leg member 2000 and the ground can be increased. This prevents the leg member 2000 from sliding or during use and enhances the stability and accuracy of the leg member 2000.

In another embodiment, three anti-slip bumps 2004 or any other configuration in a desired number are arranged at a bottom of the leg member 2000. By providing a greater number of anti-slip bumps 2004, the friction between the leg member 2000 and the ground can be effectively increased, preventing the leg member 2000 from sliding or shifting during use.

Figure 6:
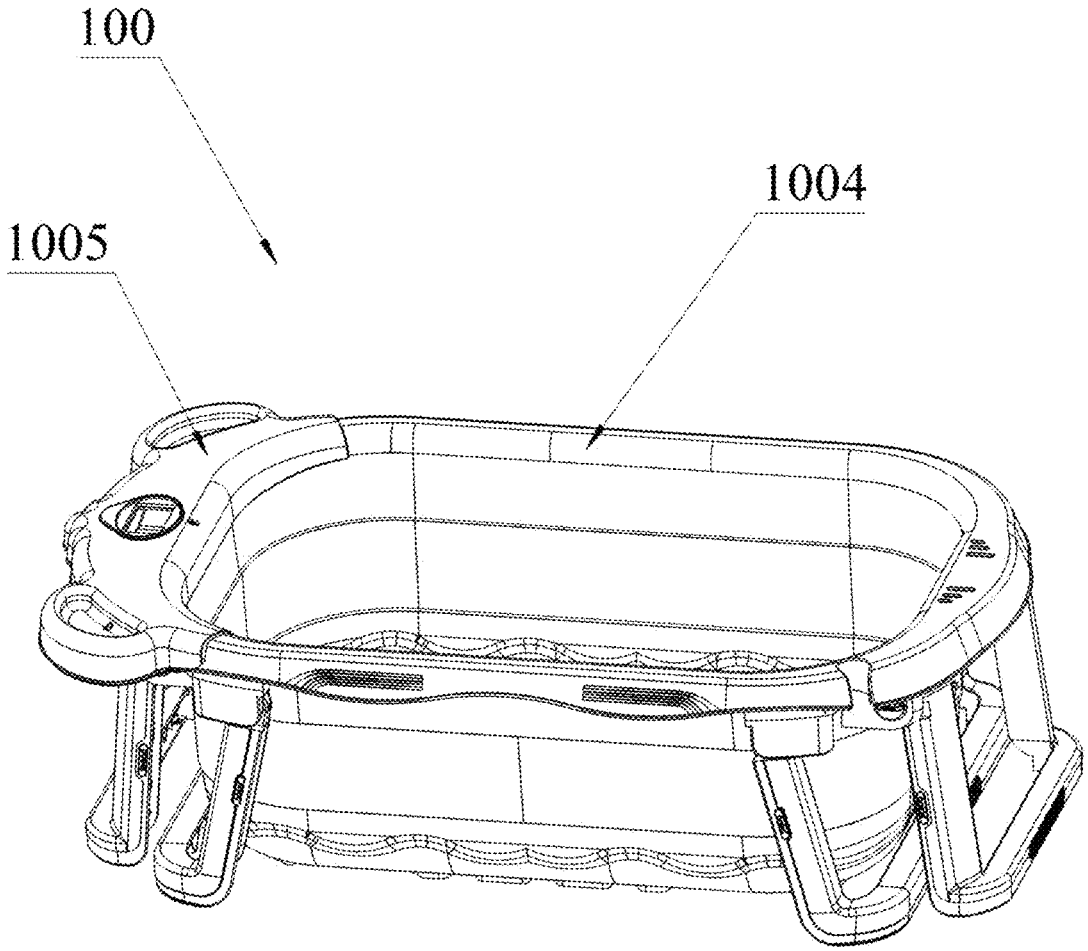
FIG. 6 is a schematic diagram of a structure of the outer edge in another embodiment of the foldable baby bathtub of the present invention.

In another embodiment, referring to FIG. 6, a tray 1005 is provided at a front end of the outer edge 1004. The tray 1005 is configured to support bath accessories, thereby enhancing the space utilization and convenience of the foldable baby bathtub 100 and catering to different user needs and preferences. The tray 1005 is configured to hold shower gel, shampoo, conditioner, soap, towels, and other commonly used bath accessories, providing easy access during bathing. The tray 1005 is also configured to place some decorative or personalized items, such as vases, candles, aromatherapy, etc., to increase the beauty and atmosphere of the bathroom, and the shape, size, color and material of the tray 1005 can be selected and matched according to the user's preference and the style of the bathroom.

Figure 7:
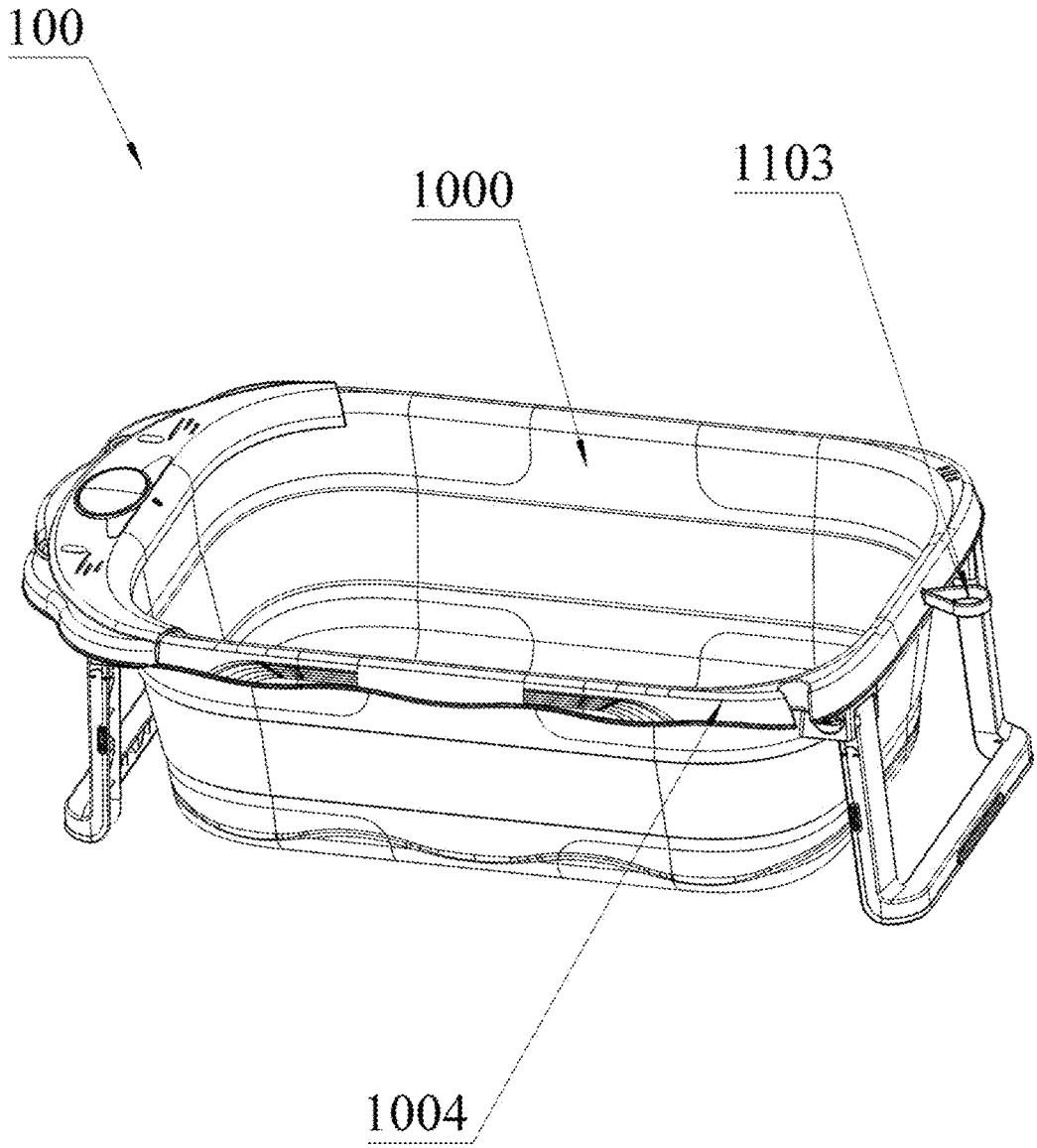
FIG. 7 is a schematic diagram of a connection structure of the outer edge connected to a tray of the foldable baby bathtub of the present invention.

In this embodiment, referring to FIG. 7, a lanyard 1103 is provided at a rear end of the outer edge 1004. And the lanyard 1103 is configured for the user to fold and shrink the foldable baby bathtub 100 and then hang it on the wrist or other places for convenient storage and portability.

Figure 8:
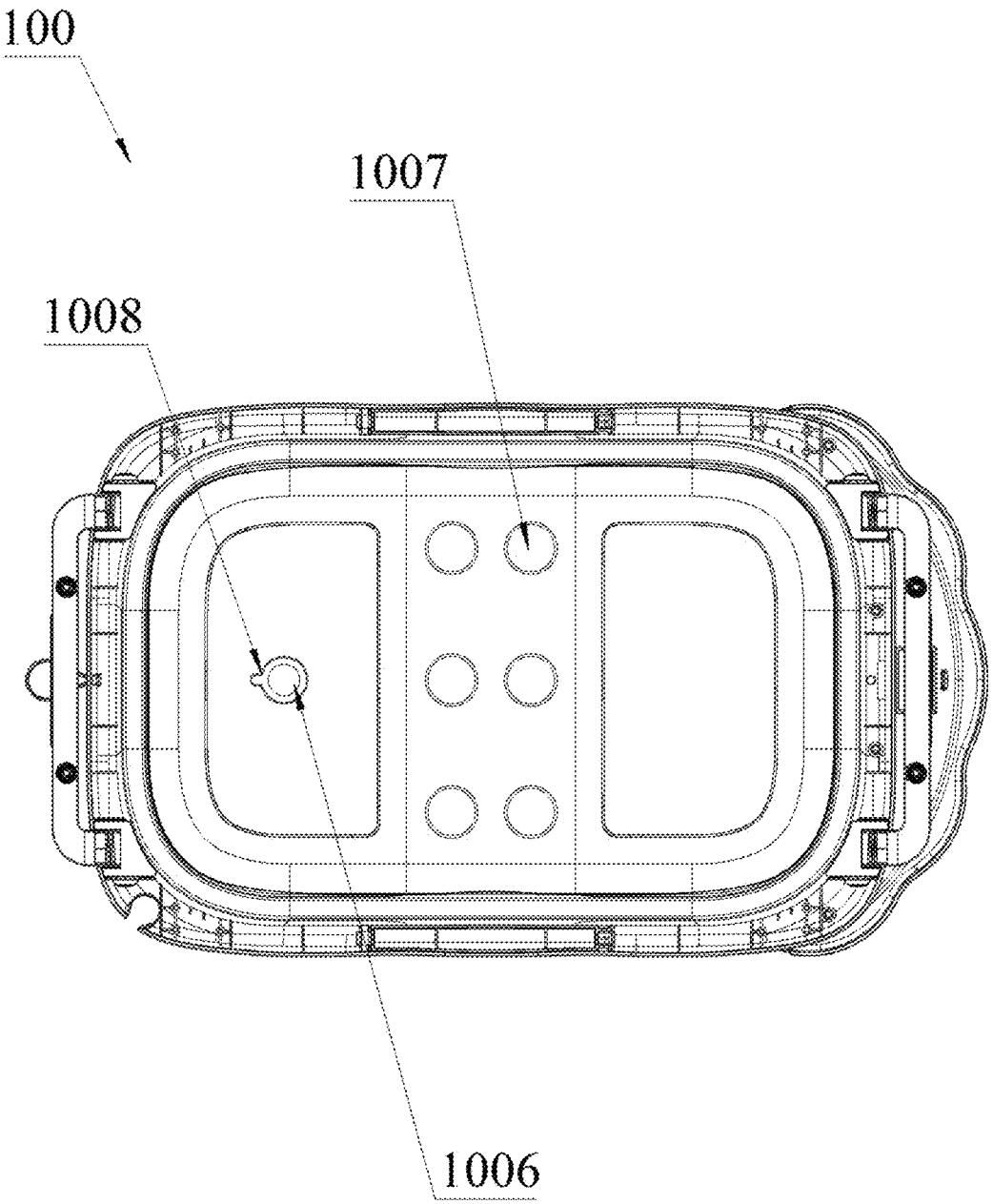
FIG. 8 is a schematic diagram of a structure of a bottom plate of the foldable baby bathtub of the present invention.

In this embodiment, referring to FIG. 8, the bottom plate 1001 is provided with a drain opening 1006, and six supporting blocks 1007 are arranged on a lower surface of the bottom plate 1001. Specifically, the supporting blocks 1007 are evenly distributed in the middle position of the bottom plate 1001. The drain opening 1006 can conveniently and quickly remove the accumulated water on the bottom plate 1001, preventing the bottom plate 1001 from being flooded and corroded. The supporting block 1007 increases the contact area between the bottom plate 1001 and the ground, enhancing the bearing capacity and anti-slip ability of the bottom plate 1001, and reducing the settlement and deformation of the bottom plate 1001.

In this embodiment, the drain opening 1006 is provided with an on-off valve 1008, and the on-off valve 1008 is configured to control a discharge of water. The setting of the on-off valve 1008 makes the drainage system more flexible and controllable, and also enhances the efficiency of its use, as the user can directly open the on-off valve 1008 to drain the water instead of moving the bathtub for drainage. This enables users to drain water more quickly and conveniently, saving both time and effort.

In another embodiment, seven supporting blocks 1007 or any other configuration in a desired number are arranged on the lower surface of the bottom plate 1001. Through providing a plurality of the supporting blocks 1007, the support force of the bottom plate 1001 can be effectively enhanced.

Figure 9:
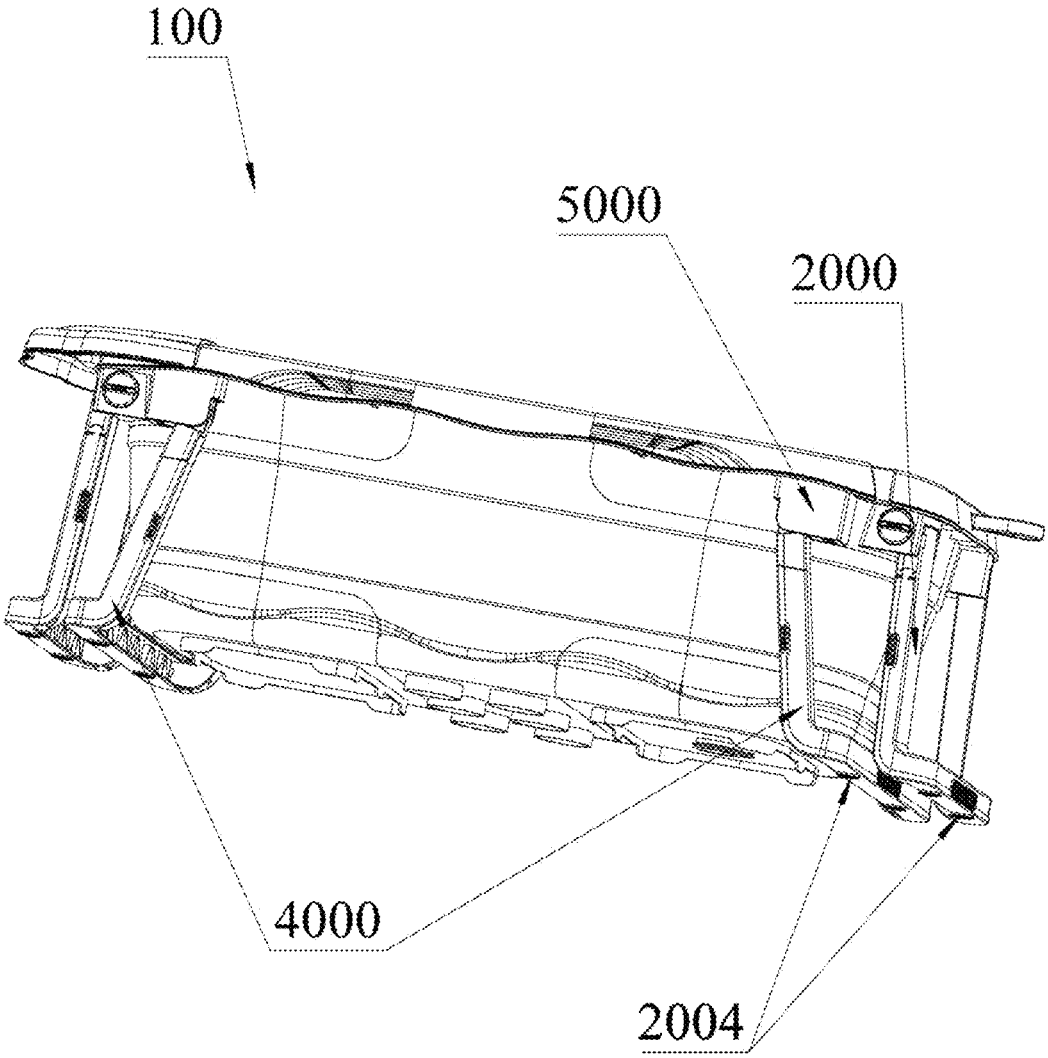
FIG. 9 is a schematic diagram of a structure of a supporting member mounted to a bathtub of the foldable baby bathtub of the present invention.

In this embodiment, referring to FIG. 9, the foldable baby bathtub 100 further includes two supporting member 4000. The supporting member 4000 is in a U-shaped structure, and two anti-slip bumps are arranged at the bottom plate of the supporting member 4000. The supporting member 4000 is firmly connected to the foldable baby bathtub 100, thereby preventing the foldable baby bathtub 100 from moving and tipping over. The anti-slip bumps at the bottom of the supporting member 4000 increase the friction between the supporting member 4000 and the ground, thus preventing the supporting member 4000 from sliding and rolling.

In another embodiment, three anti-slip bumps or any other configuration in a desired number are arranged at the bottom plate of the supporting member 4000, so as to enhance the anti-slip effect and make a whole device more stable.

Figure 10:
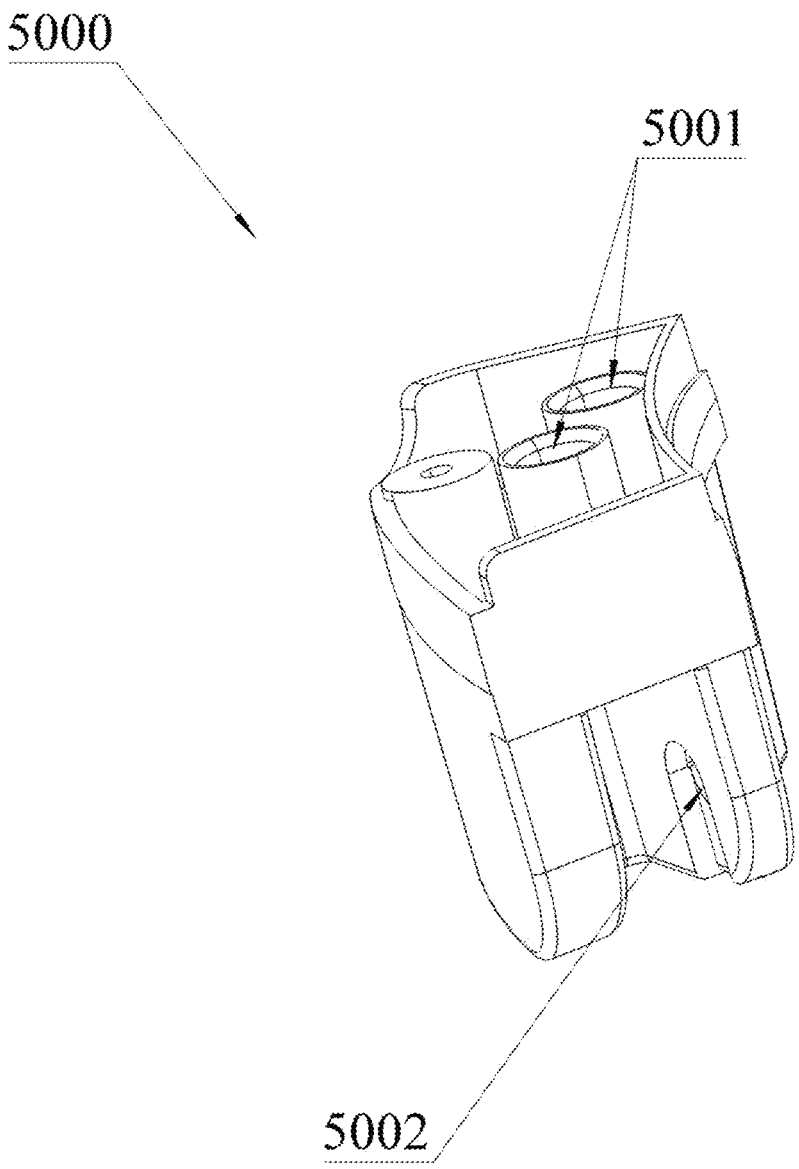
FIG. 10 is a schematic diagram of a structure of a fixing member of the foldable baby bathtub of the present invention.
Figure 11:
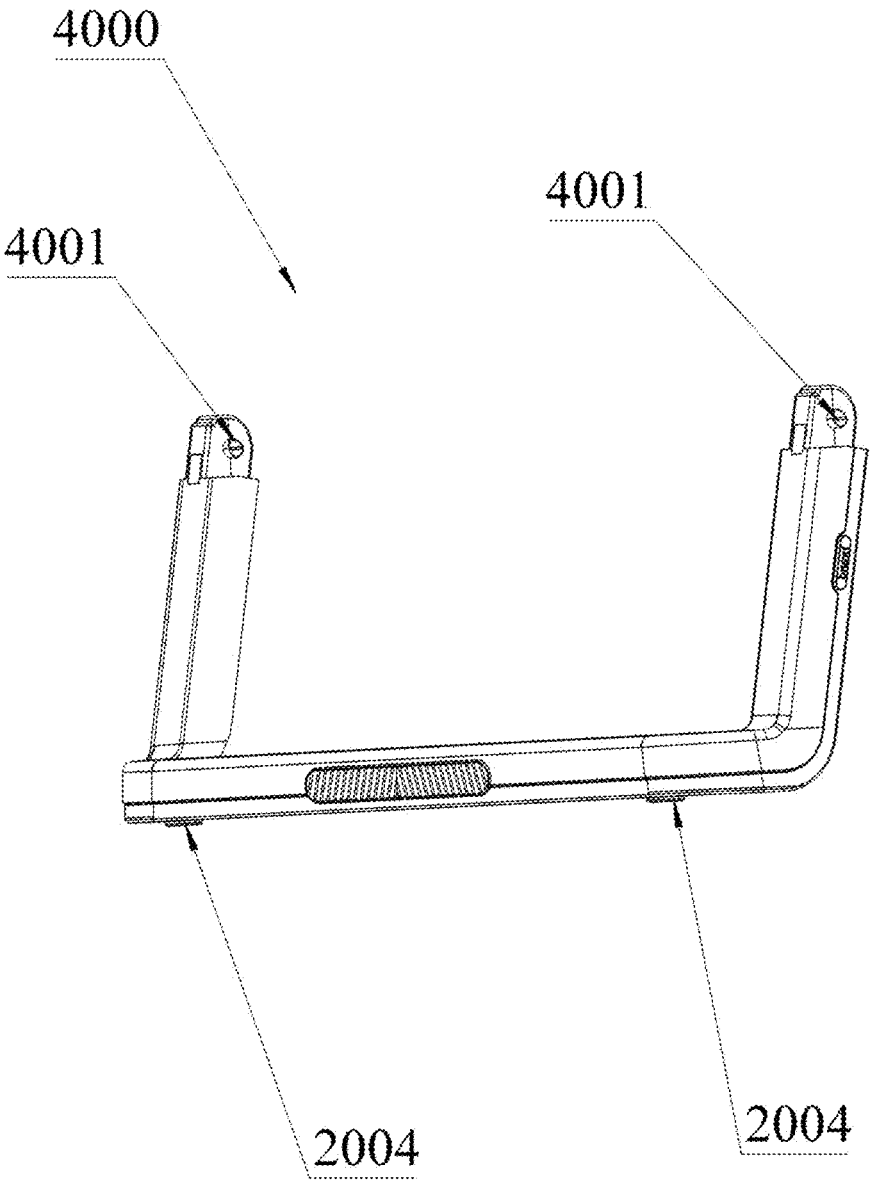
FIG. 11 is a schematic diagram of a structure of the supporting member of the foldable baby bathtub of the present invention.

In this embodiment, referring to FIG. 10 to FIG. 11, a fixing member 5000 is arranged at each of two ends of the outer edge 1004, the supporting member 4000 is fixedly connected to the outer edge 1004 by the fixing member 5000, the fixing member 5000 includes two second receiving parts 5001, and the second receiving part 5001 is received and fixed the extended part 1102, so that the fixing member 5000 is fixedly connected to the outer edge 1004. A receiving groove 5002 is arranged on each of two sides of an interior of the fixing member 5000, and a connecting shaft 4001 is arranged on each of two sides of an upper end of the supporting member 4000, and the receiving groove 5002 is configured to receive and fix the connecting shaft 4001, so that the supporting member 4000 is tightly connected to the fixing member 5000. Through fixedly connecting the supporting member 4000 to the outer edge 1004 with the fixing member 5000, the stability of the overall structure can be improved and displacement or deformation due to external forces can be prevented. Moreover, the receiving groove 5002 inside the fixing member 5000 can receive and fix the connecting shaft 4001, thus ensuring a tight connection between the supporting member 4000 and the fixing member 5000 and enhancing the reliability of the connection. In addition, the receiving groove 5002 and the connecting shaft 4001 can realize quick and easy mounting and removal of the supporting member 4000, improving work efficiency and flexibility.

In another embodiment, four second receiving parts 5001 or any other configuration in a desired number are arranged on the fixing member 5000. Through providing a plurality of second receiving parts 5001, the strength of the connection between the fixing member 5000 and the outer edge 1004 can be effectively enhanced.

Figure 12:
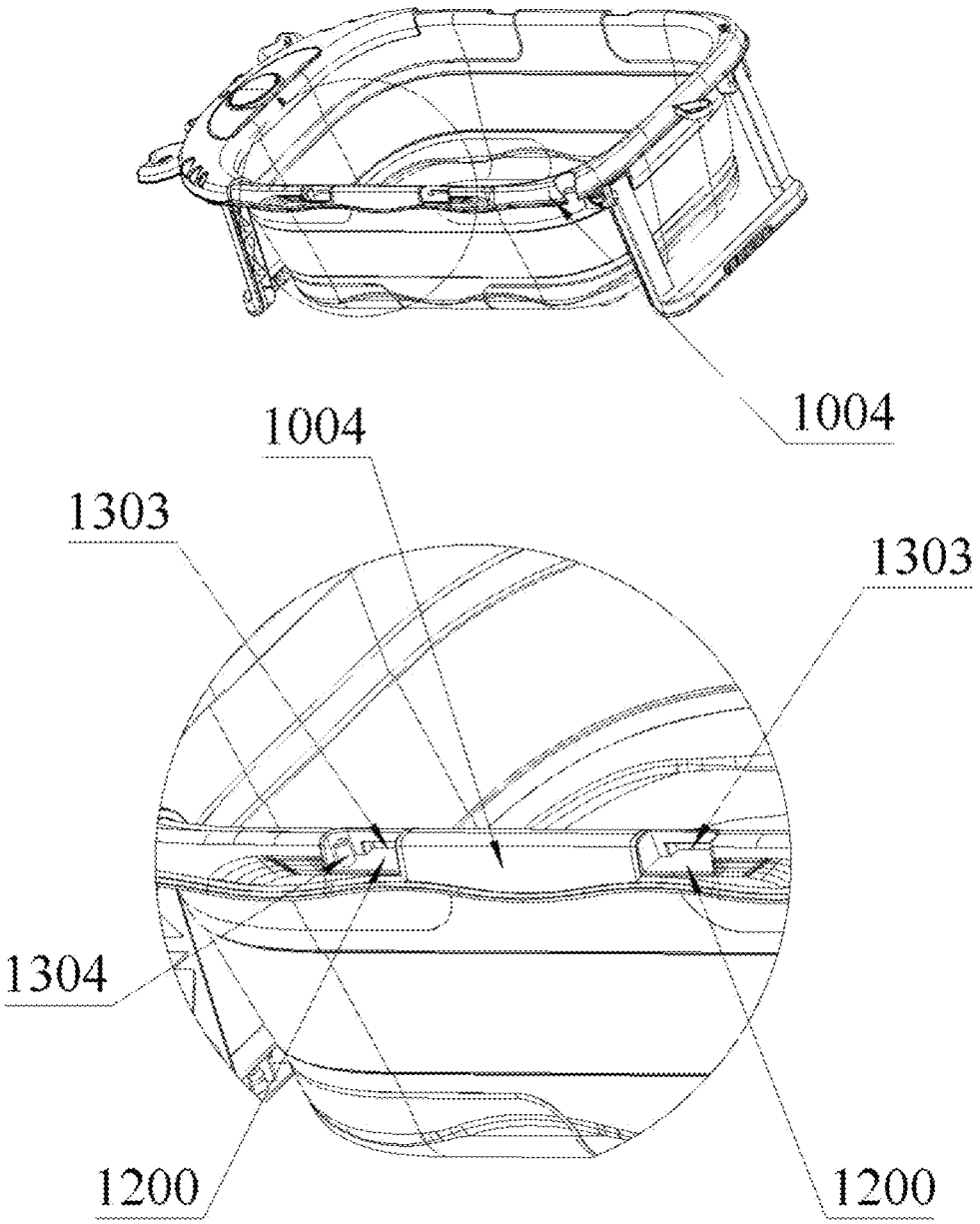
FIG. 12 is a schematic diagram of a structure of a connecting part of the foldable baby bathtub of the present invention.
Figure 13:
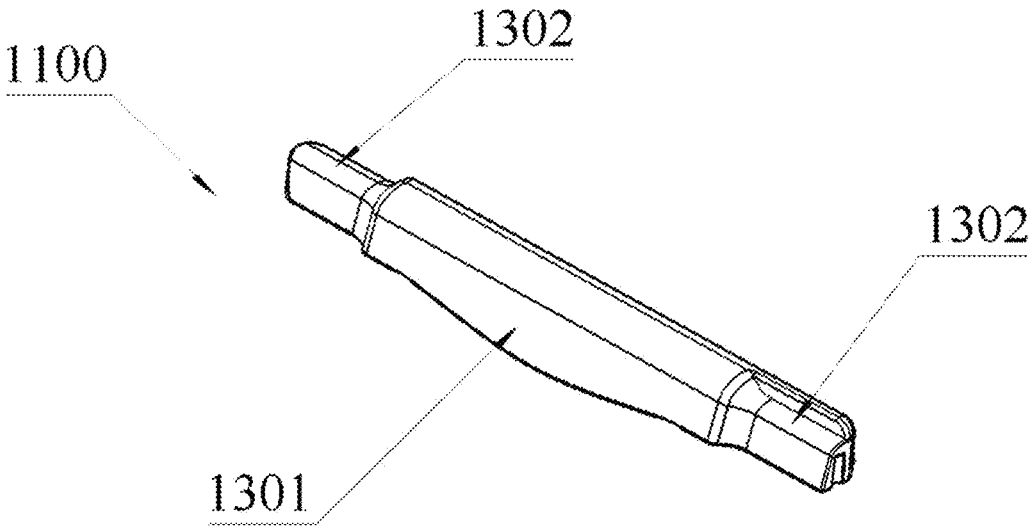
FIG. 13 is a schematic diagram of a structure of a handle of the foldable baby bathtub of the present invention.
Figure 13:
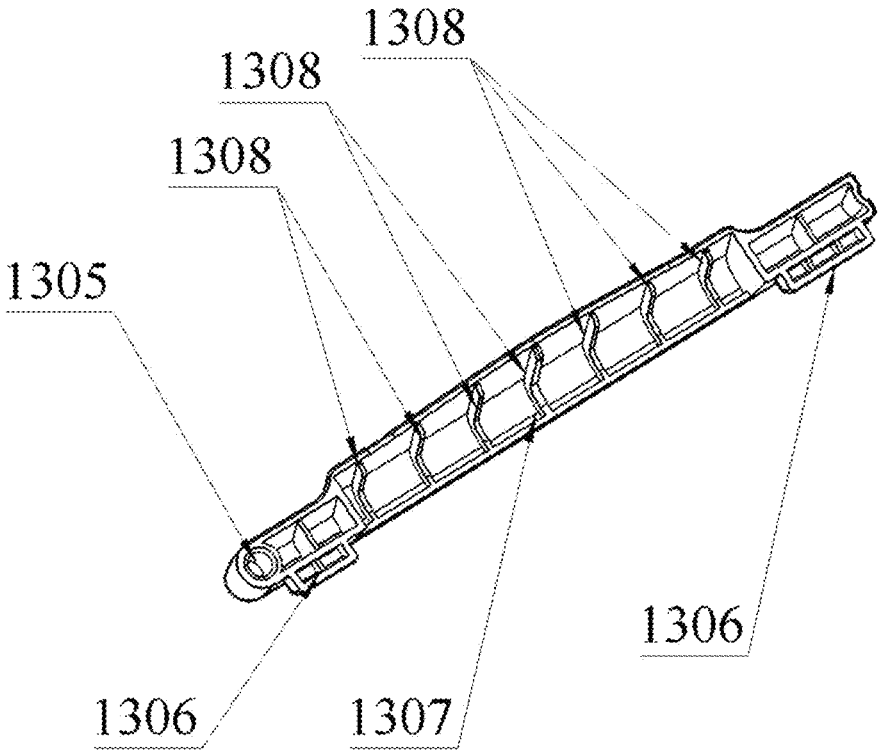
Figure 14:
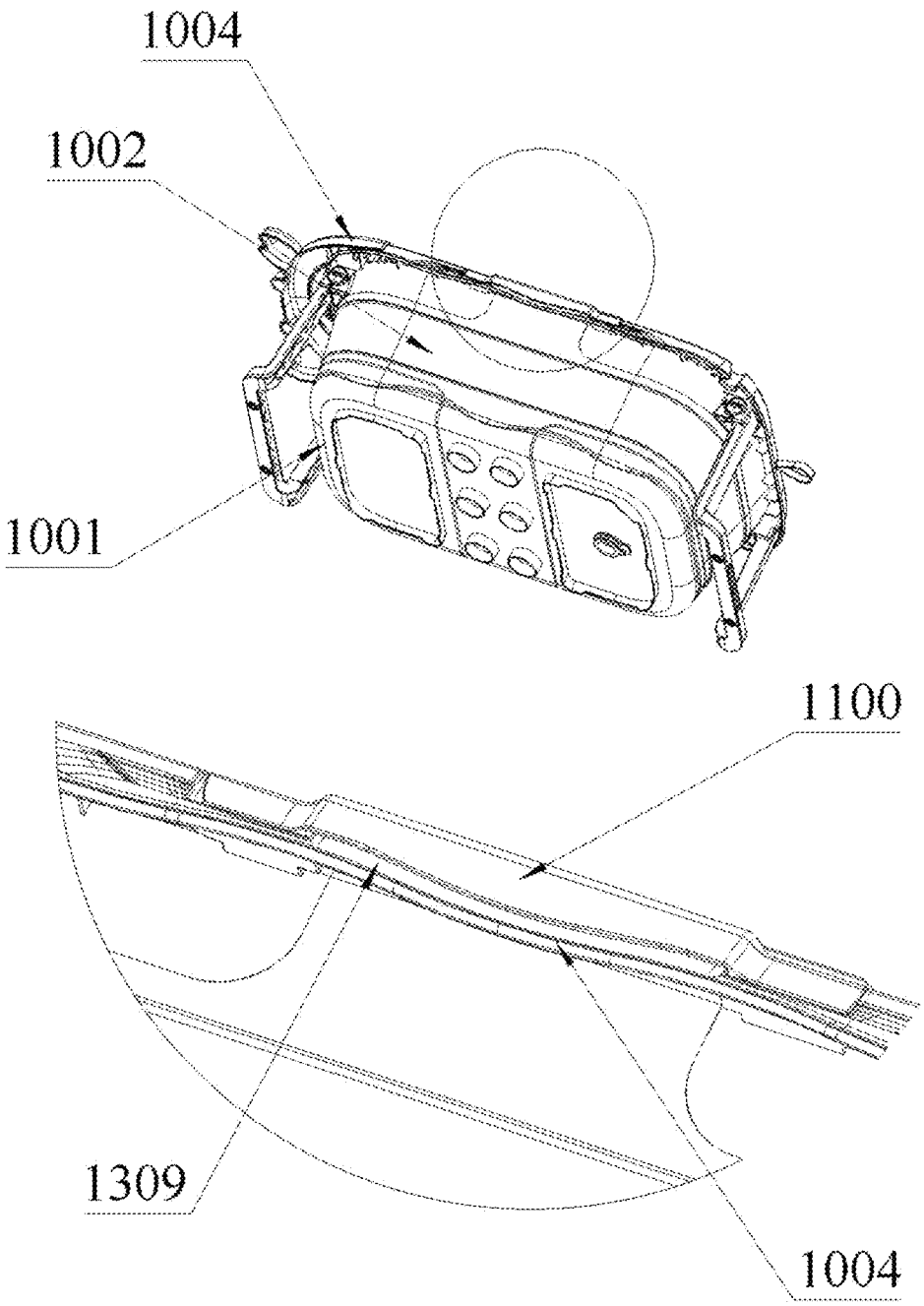
FIG. 14 is a schematic diagram of a connection structure of the handle connected to the bathtub of the foldable baby bathtub of the present invention.

In this embodiment, referring to FIG. 12 to FIG. 14, at least one connecting part 1200 is further arranged on the outer edge 1004, the handle 1100 is provided with a gripping end 1301 and at least one connecting end 1302 disposed on at least one end of the gripping end 1301, and the connecting end 1302 is detachably connected to the bathtub 1000 by the at least one connecting part 1200. The connecting part 1200 is further provided with a snap groove 1303 and a connecting column 1304, the connecting end 1302 of the handle 1100 is provided with a connecting hole 1305 and a snap fastener 1306. Furthermore, the connecting column 1304 is inserted into the connecting hole 1305, and the snap groove 1303 is configured to receive and fix the snap fastener 1306, so that the handle 1100 can be detachably mounted on the bathtub 1000. Through the insertion of the connecting column 1304 and the connecting hole 1305, as well as the cooperation of the snap fastener 1306 and the snap groove 1303, the handle 1100 can be easily disassembled and mounted. This is convenient for users to quickly replace or remove the handle 1100 when needed. Moreover, it can ensure that the handle 1100 will not be easily loosened or detached during use, thereby increasing the safety of use.

In this embodiment, the gripping end 1301 includes a contact wall 1307, the contact wall 1307 is provided with a plurality of abutting blocks 1308 on an inner wall surface of the contact wall 1307, and the abutting block 1308 abuts against the outer edge 1004, so that a gap 1309 is formed between the contact wall 1307 and the outer edge 1004. The abutting block 1308 abuts against the outer edge 1004, which can enhance the stability of the handle 1100 and prevent it from shaking or shifting during use. The gap 1309 can make it easier for a user to take the foldable baby bathtub 100 and also facilitate the user's detachment and mounting of the handle 1100.

In this embodiment, the handle 1100 is a flexible handle. The flexible handle can fit a shape of the user's hand better, providing a more comfortable holding experience and reducing fatigue during prolonged use.

Figure 15:
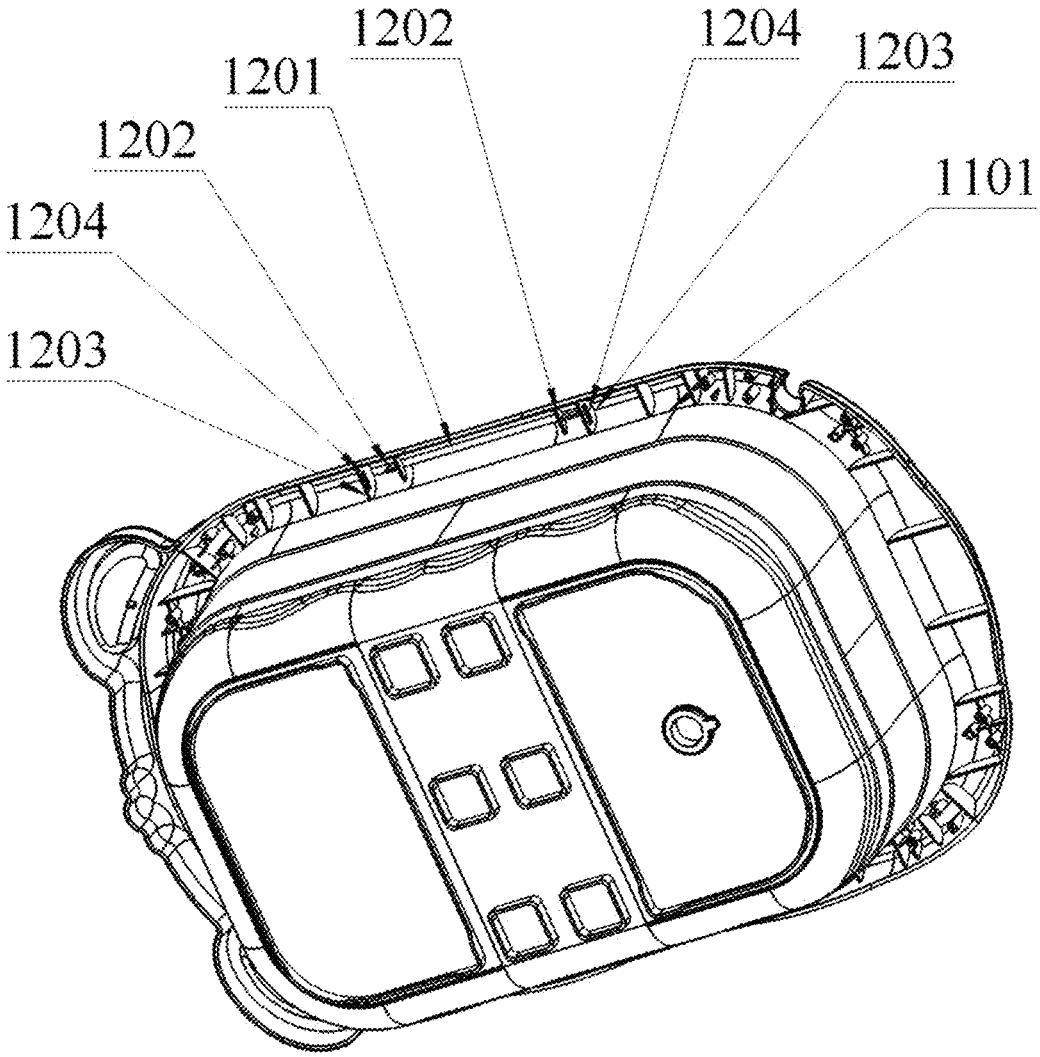
FIG. 15 is a schematic diagram of a structure of a mounting part in another embodiment of the foldable baby bathtub of the present invention.
Figure 16:
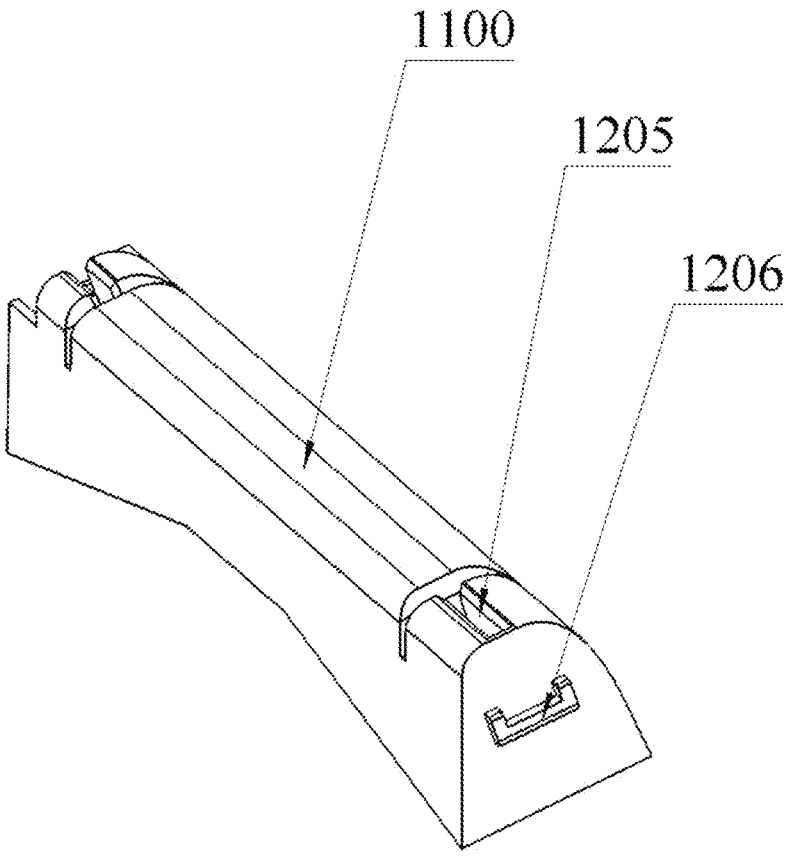
FIG. 16 is a schematic diagram of a structure of the handle in another embodiment of the foldable baby bathtub of the present invention.

In this embodiment, referring to FIG. 15 to FIG. 16, the annular groove 1101 is further provided with a mounting part 1201, and the mounting part 1201 is disposed on one of two sides of the annular groove 1101. The mounting part 1201 is provided with a clamping strip 1202, the mounting part 1201 is further provided with a baffle board 1203 on one side of the mounting part 1201, and the baffle board 1203 is provided with a through hole 1204. The handle is mounted on the mounting part, an upper portion of the handle is provided with a clamping groove 1205, the clamping groove 1205 is matingly connected to the clamping strip 1202, and each of two ends of the handle 1100 is provided with a protruding part 1206, and the protruding part 1206 is passed through and disposed into the through hole 1204. Through providing the handle 1100, users can conveniently move and adjust the position of the device, enhancing the convenience of use. Through the mating connection of the clamping groove 1205 and the clamping strip 1202, the handle 1100 can be stably fixed to prevent displacement or deformation caused by external forces. Through the design of the baffle board 1203 and the through hole 1204, users' fingers can be prevented from contacting the internal parts of the device, thus improving the safety of use.

Figure 17:
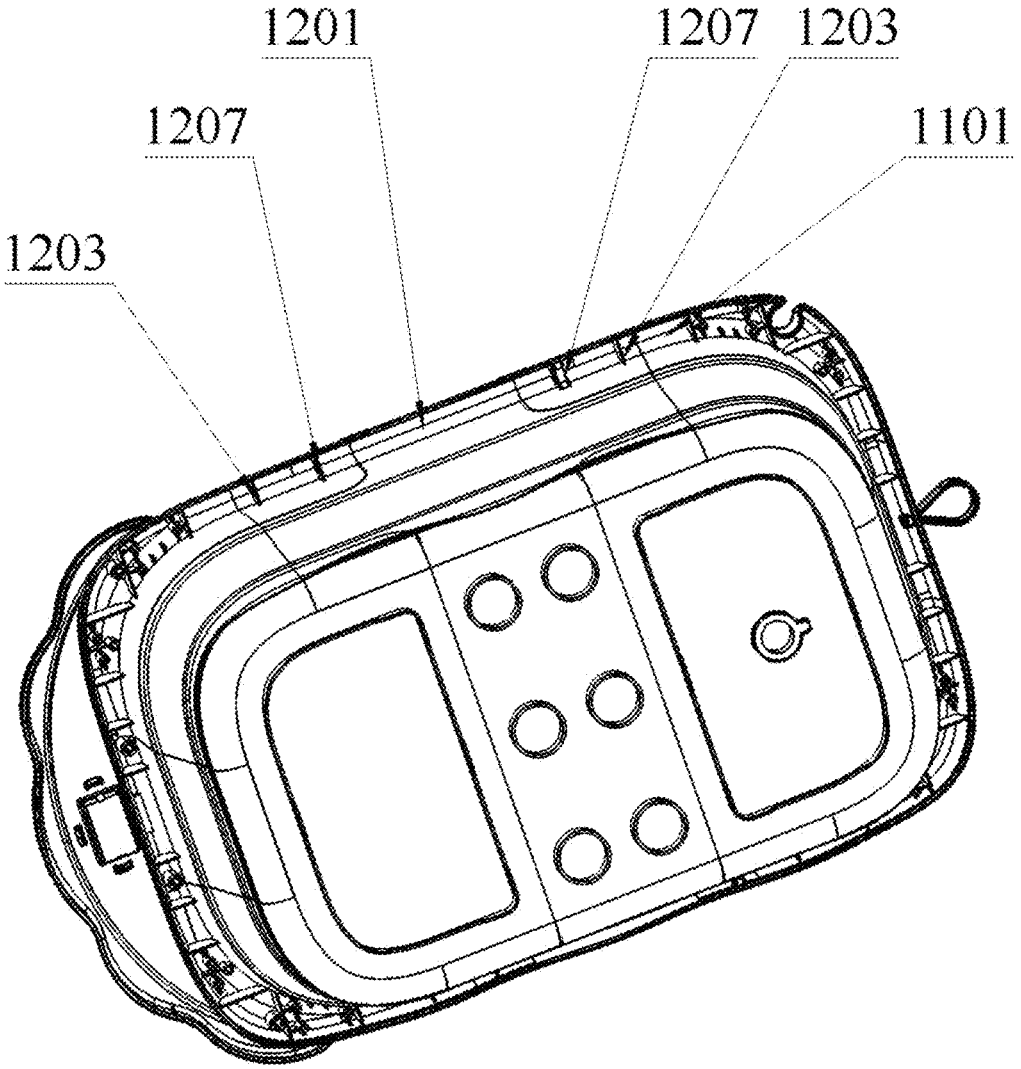
FIG. 17 is a schematic diagram of a structure of the mounting part in another embodiment of the foldable baby bathtub of the present invention.
Figure 18:
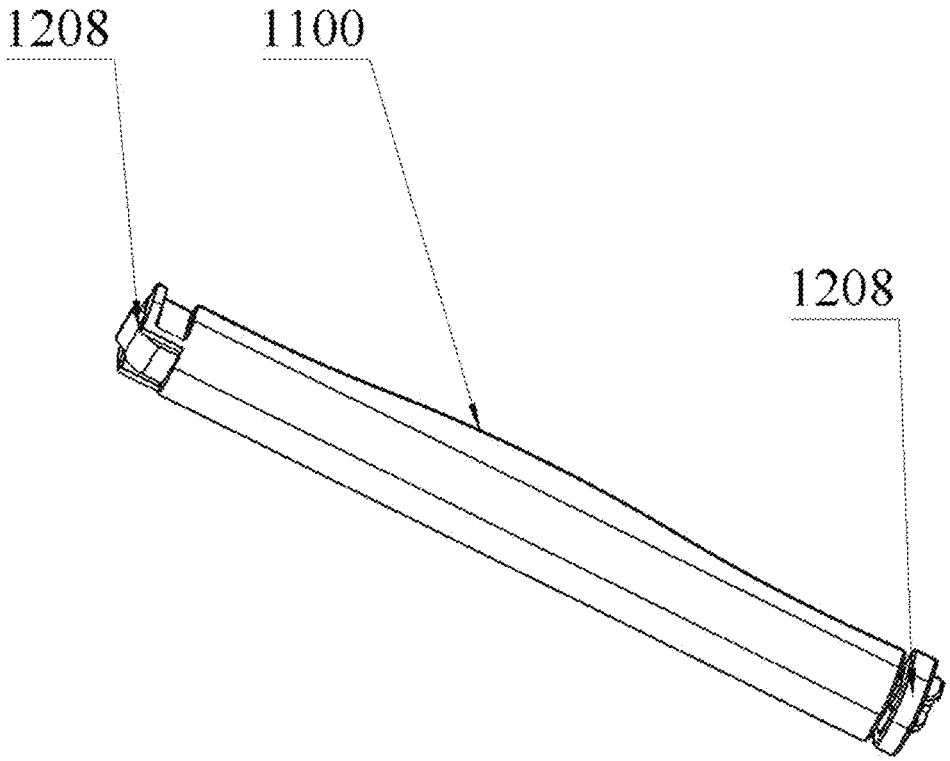
FIG. 18 is a schematic diagram of a structure of the handle in another embodiment of the foldable baby bathtub of the present invention.

In another embodiment, referring to FIG. 17 to FIG. 18, a mounting clamping groove 1207 is arranged respectively at each of two ends of the mounting part 1201, a buckle 1208 is provided at each of two ends of the handle 1100. The buckle 1208 cooperates with the mounting clamping groove 1207 to fix the handle 1100 inside the annular groove 1101.

In this embodiment, the bathtub 1000 is made of rubber material. Rubber is an extremely durable material that can withstand significant pressure and abrasion, effectively increasing the service life of the product. As rubber is a soft material, in case of accidental slips or bumps against the bathtub, rubber bathtubs may reduce the risk of injuries compared to those made of hard materials. Moreover, rubber is a good thermal insulation material, capable of maintaining the water temperature for a longer period, thus making the bathing experience more comfortable.

In another embodiment, the bathtub 1000 may be made of PVC material. PVC is a lightweight and durable substance that makes the bathtub easier to move and install. Additionally, PVC bathtubs are waterproof and easy to clean, effectively preventing the accumulation of limescale and stains. In another embodiment, the bathtub 1000 is made of a composite material consisting of rubber and other materials such as fiberglass or ceramic. This composite material combines the advantages of various materials, including the softness and durability of rubber, the strength and rigidity of fiberglass, and the smoothness and ease of cleaning of ceramic. This composite bathtub provides a more comfortable and maintenance-friendly bathing experience.

The present invention further provides a method of storing the foldable baby bathtub 100, including providing the foldable baby bathtub 100 included the bathtub 1000, and the leg member 2000 detachably connected to the bathtub 1000. The bathtub 1000 includes the bottom plate 1001, the bottom plate 1001 extends upward around to form the sidewall 1002, the bottom plate 1001 and the sidewall 1002 are formed the cavity 1003 for holding the baby body, the edge of the sidewall 1002 extends outwardly to form the outer edge 1004, and the bathtub 1000 includes the stretched state and the contracted state in the longitudinal axis direction of the bathtub 1000. And at least one connecting member 3000 is respectively arranged on the lower portion of each of two ends of the outer edge 1004.

In this embodiment, the leg member 2000 is detachably connected to the bathtub 1000 by the connecting member 3000, the connecting member 3000 is further provided with the locking device 3001, and the locking device 3001 limits and releases the leg member 2000 thereby leaving the leg member 2000 in a locked state or a relaxed state. The locking device 3001 includes the locking part 3005 and the rotating part 3006, the rotating part 3006 can rotate along a central axis, so as to drive the locking part 3005 to rotate for limiting and releasing the leg member 2000.

In this embodiment, the method for storing the foldable baby bathtub 100 is as follows: after draining the water from the bathtub 100, dry the water stains on its surface. Rotate the rotating part 3006 so that the locking device 3001 is in a relaxed state and then detach the leg member 2000. Place the detached leg member 2000 in the cavity 1003 and press down on the bathtub 1000 to make it fold and contract. Finally, place the folded and contracted foldable baby bathtub 100 in a suitable place to complete the storage.

In addition, various different implementation modes of the present disclosure can also be arbitrarily combined, and these combinations should also be regarded as the content disclosed in the present disclosure, as long as they do not violate the idea of the present disclosure.

What is claimed is:

1. A foldable baby bathtub, comprising:

a bathtub;

a handle connected to the bathtub, and a leg member detachably connected to the bathtub, wherein the bathtub comprises a bottom plate and a sidewall connecting the bottom plate, the bottom plate extends upward around to form the sidewall, the bottom plate and the sidewall are configured to form a cavity for holding a baby body, an edge of the sidewall extends outwardly to form an outer edge, wherein at least one connecting member is respectively arranged at each of two ends of the outer edge, the leg member is detachably connected to the bathtub by the connecting member, the connecting member is provided with a locking device, and the locking device is configured to limit and release the leg member thereby leaving the leg member in a locked state or a relaxed state.

2. The foldable baby bathtub according to claim 1, wherein the outer edge forms an annular groove with an outer surface of the sidewall, at least one extended part is arranged at each of two ends of the annular groove, at least one first receiving part is arranged at an upper end of the connecting member, and the first receiving part is received the extended part so that the connecting member is fixedly connected to the outer edge.

3. The foldable baby bathtub according to claim 2, wherein one side of the connecting member is provided with a groove, the other side of the connecting member is provided with a mounting hole, and the locking device is fixedly arranged in the mounting hole.

4. The foldable baby bathtub according to claim 3, wherein the locking device comprises a locking part and a rotating part, the rotating part is able to rotate along a central axis, so as to drive the locking part to rotate for limiting and releasing the leg member.

5. The foldable baby bathtub according to claim 4, wherein the leg member comprises a connecting end, one side of the connecting end is provided with a convex strip, the convex strip is matingly connected to the groove, the other side of the connecting end is provided with a locking groove, and the locking groove is received the locking part.

6. The foldable baby bathtub according to claim 5, wherein the leg member is provided with a U-shaped structure, and at least one anti-slip bump is arranged at a bottom of the leg member.

7. The foldable baby bathtub according to claim 6, wherein the outer edge is provided with a tray, and the tray is configured to support bath accessories.

8. The foldable baby bathtub according to claim 7, wherein the bottom plate is provided with a drain opening, and at least one supporting block is provided on a lower surface of the bottom plate.

9. The foldable baby bathtub according to claim 8, wherein the drain opening is provided with an on-off valve, and the on-off valve is configured to control a discharge of water.

10. The foldable baby bathtub according to claim 9, wherein the bathtub is made of rubber material.

11. The foldable baby bathtub according to claim 10, wherein the baby bath further comprises at least one supporting member, the supporting member is in a U-shaped structure, and at least one anti-slip bump is arranged at a bottom plate of the supporting member.

12. The foldable baby bathtub according to claim 11, wherein a fixing member is arranged at each of two ends of the outer edge, the supporting member is fixedly connected to the outer edge by the fixing member, the fixing member comprises at least one second receiving part, and the second receiving part is received and fixed the extended part, so that the fixing member is fixedly connected to the outer edge.

13. The foldable baby bathtub according to claim 12, wherein a receiving groove is arranged on each of two sides of an interior of the fixing member, and a connecting shaft is arranged on each of two sides of an upper end of the supporting member, and the receiving groove is configured to receive and fix the connecting shaft, so that the supporting member is connected to the fixing member.

14. The foldable baby bathtub according to claim 2, wherein the annular groove is further provided with a mounting part, the mounting part is disposed on one of two sides of the annular groove, the mounting part is provided with a clamping strip, the mounting part is further provided with a baffle board on one side of the mounting part, and the baffle board is provided with a through hole.

15. The foldable baby bathtub according to claim 14, wherein the handle is mounted on the mounting part, an upper portion of the handle is provided with a clamping groove, the clamping groove is matingly connected to the clamping strip, and each of two ends of the handle is provided with a protruding part, and the protruding part is passed through and disposed into the through hole.

16. The foldable baby bathtub according to claim 1, wherein the bathtub is made of a kind of soft material including one of rubber material, PVC material, a composite material consisting of rubber and fiberglass, and a composite material consisting of rubber and ceramic.

17. A foldable baby bathtub, comprising:

a bathtub; and a handle connected to the bathtub, wherein the bathtub comprises a bottom plate and a sidewall connecting the bottom plate, the bottom plate extends upward around to form the sidewall, the bottom plate and the sidewall are configured to form a cavity for holding a baby body, an edge of the sidewall extends outwardly to form an outer edge, wherein at least one connecting part is further arranged on the outer edge, the handle is provided with a gripping end and at least one connecting end disposed on at least one end of the gripping end, and the connecting end is detachably connected to the bathtub by the at least one connecting part.

18. The foldable baby bathtub according to claim 17, wherein the connecting part is further provided with a snap groove and a connecting column, the handle is provided with a connecting hole and a snap fastener, the connecting column is inserted into the connecting hole, and the snap groove is configured to receive and fix the snap fastener, so that the handle is able to detachably mount on the bathtub.

19. The foldable baby bathtub according to claim 18, wherein the gripping end comprises a contact wall, the contact wall is provided with a plurality of abutting blocks on an inner wall surface of the contact wall, and the abutting block abuts against the outer edge, so that a gap is formed between the contact wall and the outer edge.

20. The foldable baby bathtub according to claim 19, wherein the handle is a flexible handle.

* * * * *